US006607322B2

(12) United States Patent
Aruga et al.

(10) Patent No.: US 6,607,322 B2
(45) Date of Patent: Aug. 19, 2003

(54) PRINTER UNIT FOR TRANSACTION DEVICE

(75) Inventors: Kotoya Aruga, Nagano (JP); Hiroshi Takizawa, Nagano (JP); Yoshihiro Shikano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/880,096

(22) Filed: Jun. 14, 2001

(65) Prior Publication Data

US 2002/0018685 A1 Feb. 14, 2002

(30) Foreign Application Priority Data

Jun. 28, 2000 (JP) ..... P2000-195013

(51) Int. Cl.[7] ..... B41J 15/02; B41J 29/02
(52) U.S. Cl. ..... 400/613; 400/611; 400/693
(58) Field of Search ..... 400/611, 613, 400/691, 693

(56) References Cited

U.S. PATENT DOCUMENTS

| | | | | | |
|---|---|---|---|---|---|
| 4,860,031 | A | * | 8/1989 | Lejcek | 346/136 |
| 5,230,576 | A | * | 7/1993 | Sone | 400/649 |
| 5,588,755 | A | * | 12/1996 | Nimura | 400/234 |
| 6,079,891 | A | * | 6/2000 | Berthelot | 400/690.4 |
| 6,129,465 | A | | 10/2000 | Hoyt et al. | 400/578 |

FOREIGN PATENT DOCUMENTS

| | | | | |
|---|---|---|---|---|
| DE | 298 04 009 | | 5/1998 | |
| EP | 0 928 765 | | 7/1999 | |
| JP | 59-64379 | | 4/1984 | |
| JP | 60-247580 | | 12/1985 | |
| JP | 6-73017 | | 10/1994 | |
| JP | 7-221913 | | 8/1995 | |
| JP | 08293957 | A * | 11/1996 | ..... H04N/1/00 |
| JP | 9-138878 | | 5/1997 | |
| JP | 10-101252 | | 4/1998 | |
| JP | 10129053 | A * | 5/1998 | ..... B41J/11/14 |
| JP | 10-193740 | | 7/1998 | |
| JP | 11078146 | A * | 3/1999 | ..... B41J/15/00 |
| JP | 2000-71535 | | 3/2000 | |

OTHER PUBLICATIONS

Machine translation of JP 10–129053 from Japanese Patent Office website.*

Patent Abstract of Japan, vol. 1999, No. 13, Nov. 30, 1999 and JP 11 217138 (Toshiba Tec Corp.).

Patent Abstract of Japan, vol. 1998, No. 1, Jan. 30, 1998 and JP 09 254495 (Hitachi Ltd.).

* cited by examiner

*Primary Examiner*—Daniel J. Colilla
(74) *Attorney, Agent, or Firm*—Nixon & Vanderhye P.C.

(57) ABSTRACT

A printer unit 20 has a base frame 24 and a moving frame 26 supported thereon for rotation relative thereto so that the upper part of the moving frame can be inclined to the front of an installation-type transaction device. The moving frame 26 is provided with a bearing member 40 that supports a shaft of the rolled paper, a print mechanism section 46, an edge of paper insertion slot 44 for introducing the rolled-paper end into the print section, and an edge of paper discharge port 50*a*. The bearing member 40 has a rolled-paper-shaft acceptance port 40*b* that is opened to the rear of the moving frame, and the edge of paper insertion slot 44 is oriented to the rear of the moving frame. At maintenance and inspection time, the moving frame 26 is inclined forward, whereby the shaft acceptance port 40*b* and the edge of paper insertion slot 44 are oriented to the worker.

10 Claims, 9 Drawing Sheets

46
48
46a
50
r
44
46b
50a
26a
26
R
40c
42
40
28
40b
32
24e
24d
40a
26b
38
34
36
30
24c
34a
34b
24a
24b
24

PRINTER UNIT FOR TRANSACTION DEVICE

BACKGROUND OF THE INVENTION

1. Field of the Invention

This invention relates to a printer unit that is installed in a body of an installation-type transaction device such as an ATM (automatic teller machine). The printer makes it possible to supply an edge of paper of printed rolled-paper from the operation, or front, face of the body.

2. Related Art

Stand-alone transaction devices, generally called kiosk terminals, have become widespread with development of information technologies. These transaction devices include ATMs, various ticket dispensers, reservation machines of concerts, etc., and selling terminals of games, music software, etc., installed in banks, stations, airports, convenience stores, etc. This kind of transaction device comprises a printer unit containing rolled paper in a body. The paper can be printed with information to be provided for the user, whereby paying-in and paying-out statements, tickets, raincheck, receipts, etc., can be distributed.

In this kind of printer unit containing rolled-paper, replacing an old roll of paper with new rolled paper, maintenance and inspection of the machine, etc., needs to be conducted at regular or irregular time intervals. In the printer unit of the related art, the frame of the printer unit slidably can be drawn out relative to the body of the transaction device and, when the above-mentioned work is conducted, the print unit is drawn out to the front, the rear, or one side of the body.

However, the printer unit in the related art involves the following problems:

(1) Even to conduct relatively simple work of replacing rolled-paper, handling a paper jam, etc., the whole unit needs to be drawn out completely from the body of the transaction device to conduct the work. Also, usually, the worker needs to access the rear side of the unit, thereby making workability extremely poor; and (2) Space for allowing the unit to be drawn out needs to be provided in the area surrounding the transaction device, and this point must be considered for installing the transaction device.

SUMMARY OF INVENTION

It is, therefore, an object of the invention to provide a printer unit for improving workability, thereby making it comparatively easy to replace rolled paper, to handle a paper jam, etc.

It is another object of the invention to provide a printer unit whose work area may be comparatively small.

To the above-described ends, according to the present invention, there is provided a printer unit—for a transaction device—that is installed in a body of an installation-type transaction device. The printer unit makes it possible to supply an edge of paper of printed rolled paper from an operation face of the body, the printer unit comprises:

a base frame for fixation to the inside of the body of the installation-type transaction device;

a moving frame placed on the base frame and supported on the base frame for rotation relative thereto about a rotation center, so that an upper part of the moving frame can be inclined to the front of the operation face of the installation-type transaction device, the moving frame for forming, together with the base frame, a storage space for rolled paper;

a bearing member, attached to a side of the moving frame, for supporting a shaft of the rolled paper stored in the rolled-paper storage space, the bearing member having an acceptance port, opened in the rear face of the moving frame, wherein the acceptance port receives the shaft of the rolled paper;

a print mechanism section placed above the rolled-paper storage space in the moving frame;

an edge of paper insertion slot attached to a side of the moving frame for guiding the edge of paper, of the rolled paper stored in the storage space, to the print mechanism section, the edge of paper insertion slot being oriented to a rear face of the moving frame; and an edge of paper discharge port, being attached to the side of the moving frame, for discharging the edge of paper of the rolled paper to the front of the installation-type transaction device.

Preferably, in the invention, the printer unit further comprises a load generating mechanism including a rack, and a pinion for meshing with the rack, wherein the rack is attached to one of the base frame and the moving frame, and the pinion is attached to the other of the base frame and the moving frame. The load generating mechanism resists rotation of the moving frame relative to the base frame by generating a load as the rack and the pinion mesh with each other.

In this case, the rack of the load generating mechanism has a tooth surface placed along a circular arc having the rotation center of the moving frame as its center. Alternatively, the rack of the load generating mechanism can have a tooth surface placed along a line gradually shifted to the pinion side as the inclination angle of the moving frame increases, wherein the shift is relative to a circular arc having the rotation center of the moving frame as its center, whereby as the inclination angle of the moving frame increases, the load resisting rotation of the moving frame increases.

Preferably, the bearing member further comprises an introduction face that is inclined horizontally, when the moving frame is inclined, for introducing the shaft of the rolled-paper into the acceptance port.

The printer unit can further comprise a printer control unit that is attached to the side of the moving frame, and that has a connection interface section for communicating with the installation-type transaction device.

According to another aspect of the invention, there is provided a printer unit, for an transaction device, comprising:

a base frame;

a moving frame rotatable, about a rotation center, between a first position and a second position with respect to the base frame in such a manner that the moving frame is rotatable to the first position so as to store rolled paper in a rolled-paper storage space and the moving frame is rotatable to the second position so as to allow replacement of the rolled paper, the moving frame including:

a rolled-paper shaft for journaling the rolled paper;

a print head for printing on the rolled paper; and a paper-discharge presenter for discharging the paper printed by the print head, wherein the moving frame is rotatable relative to the base frame by a rack and pinion, and the rack is disposed along an arc having the rotation center as its center.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DESCRIPTION OF THE PREFERRED EMBODIMENTS

Figure 1:
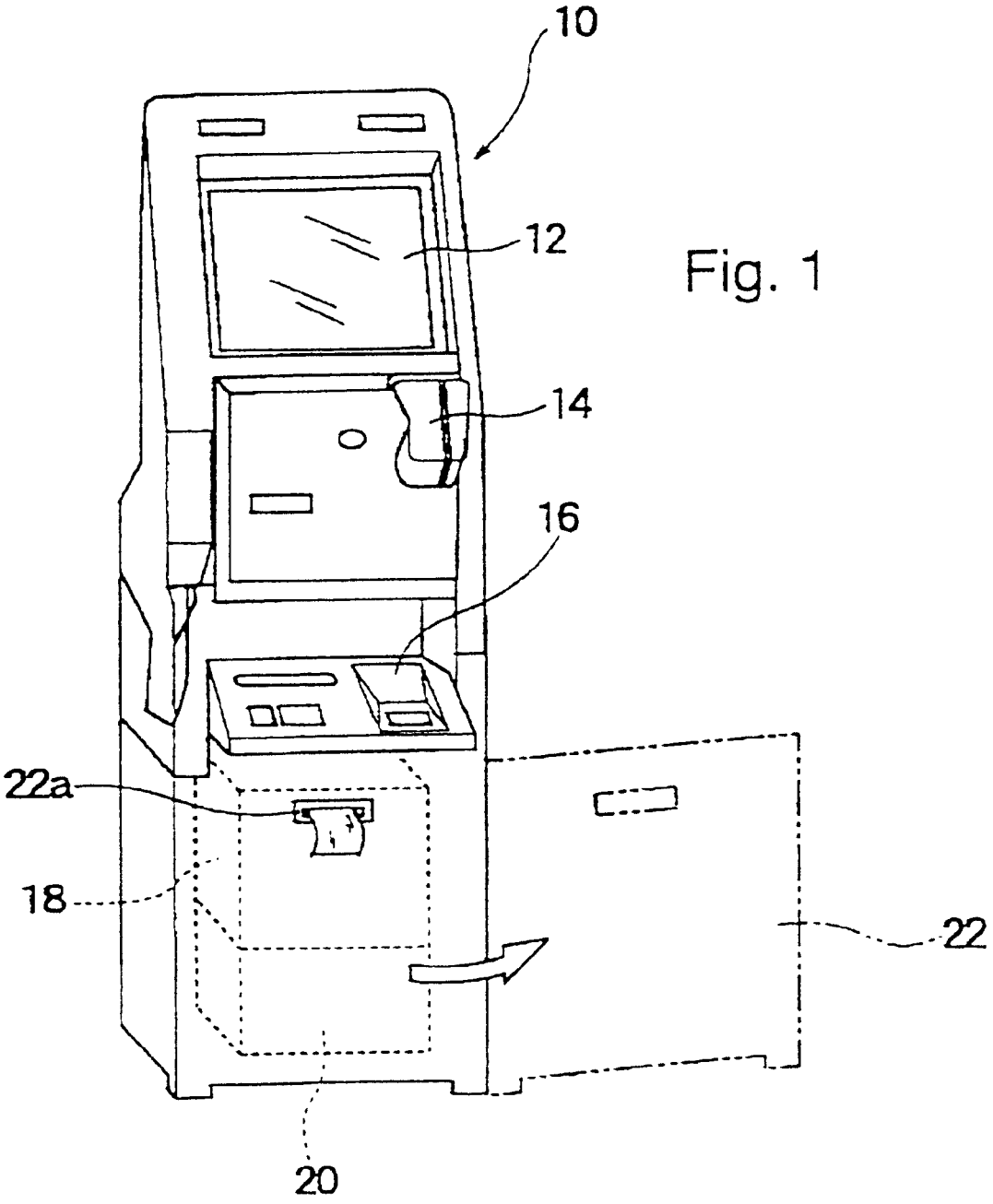
FIG. 1 is an external perspective view of an ATM terminal installing a printer unit according to the present invention.

Referring now to the accompanying drawings, there are shown preferred embodiments of the invention. FIG. 1 is an external perspective view of an ATM terminal installing a printer unit according to the invention. An ATM terminal 10 has a body structure with the front as an operation face and comprises a display 12, a card reader 14, a cash deposit/dispenser section 16, etc., installed on the operation face. A housing space 18, of printer unit 20, is provided below the cash deposit/dispenser section 16, and is covered by a front door 22. When front door 22 is opened, the worker can access the printer unit 20. A use statement of the ATM is printed by the printer unit 20, and is provided to the user through an opening 22*a* of the door.

Figure 2:
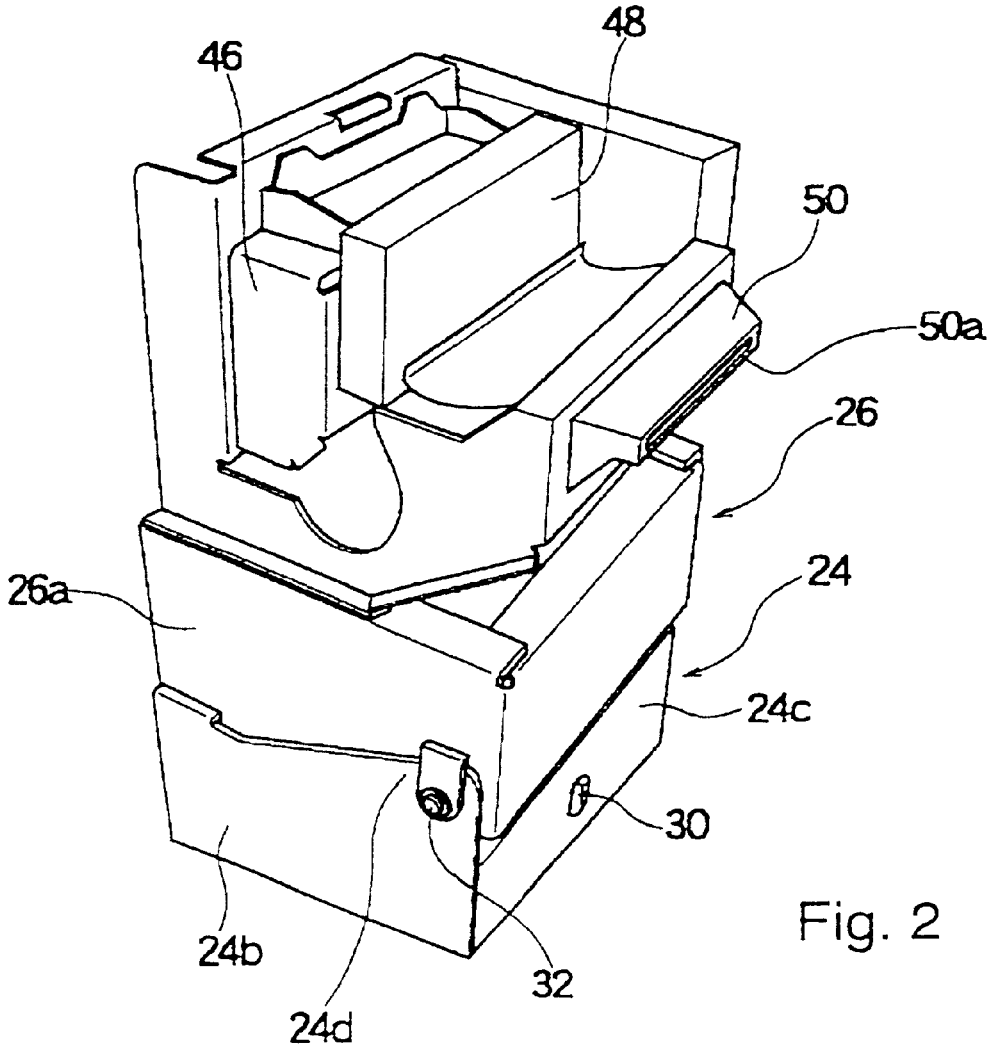
FIG. 2 is a front external perspective view of the printer unit according to the present invention.
Figure 3:
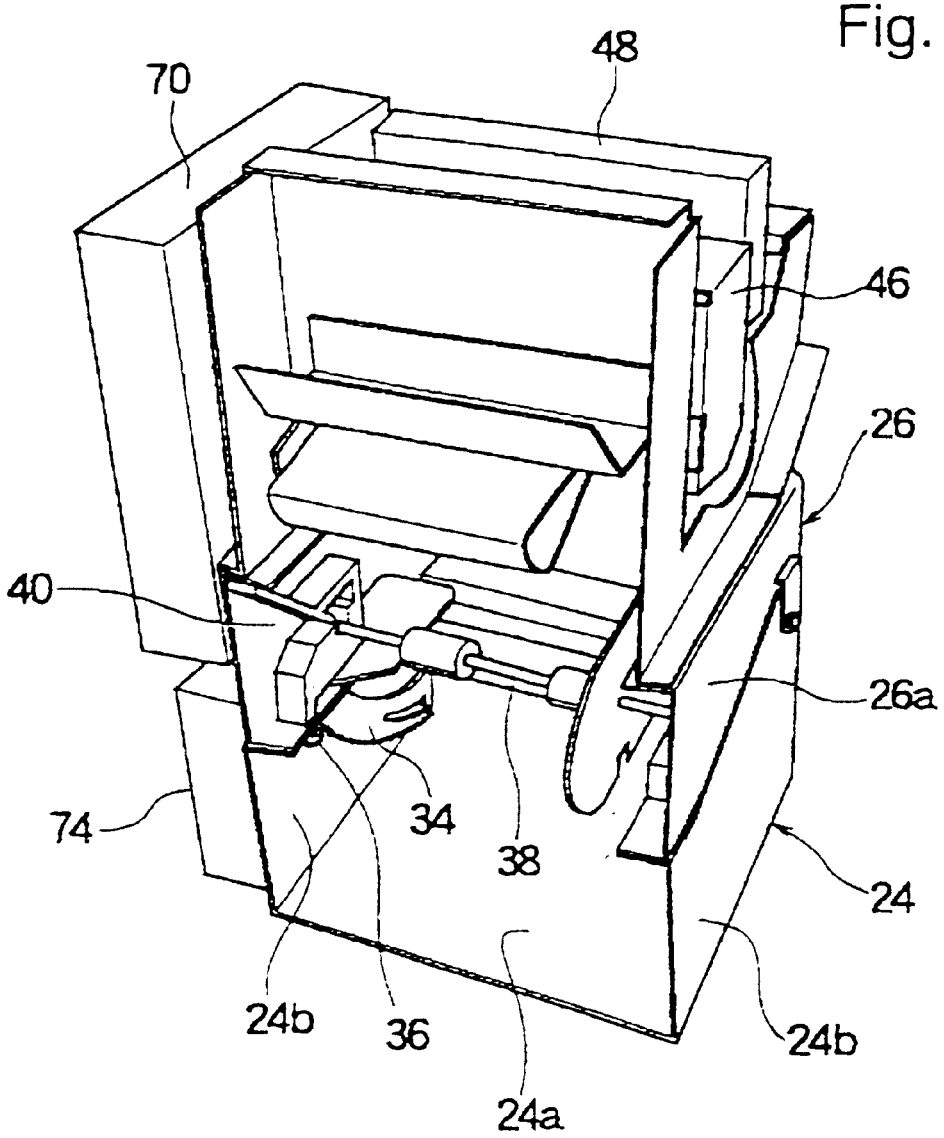
FIG. 3 is a rear external perspective view of the printer unit according to the present invention.
Figure 4:
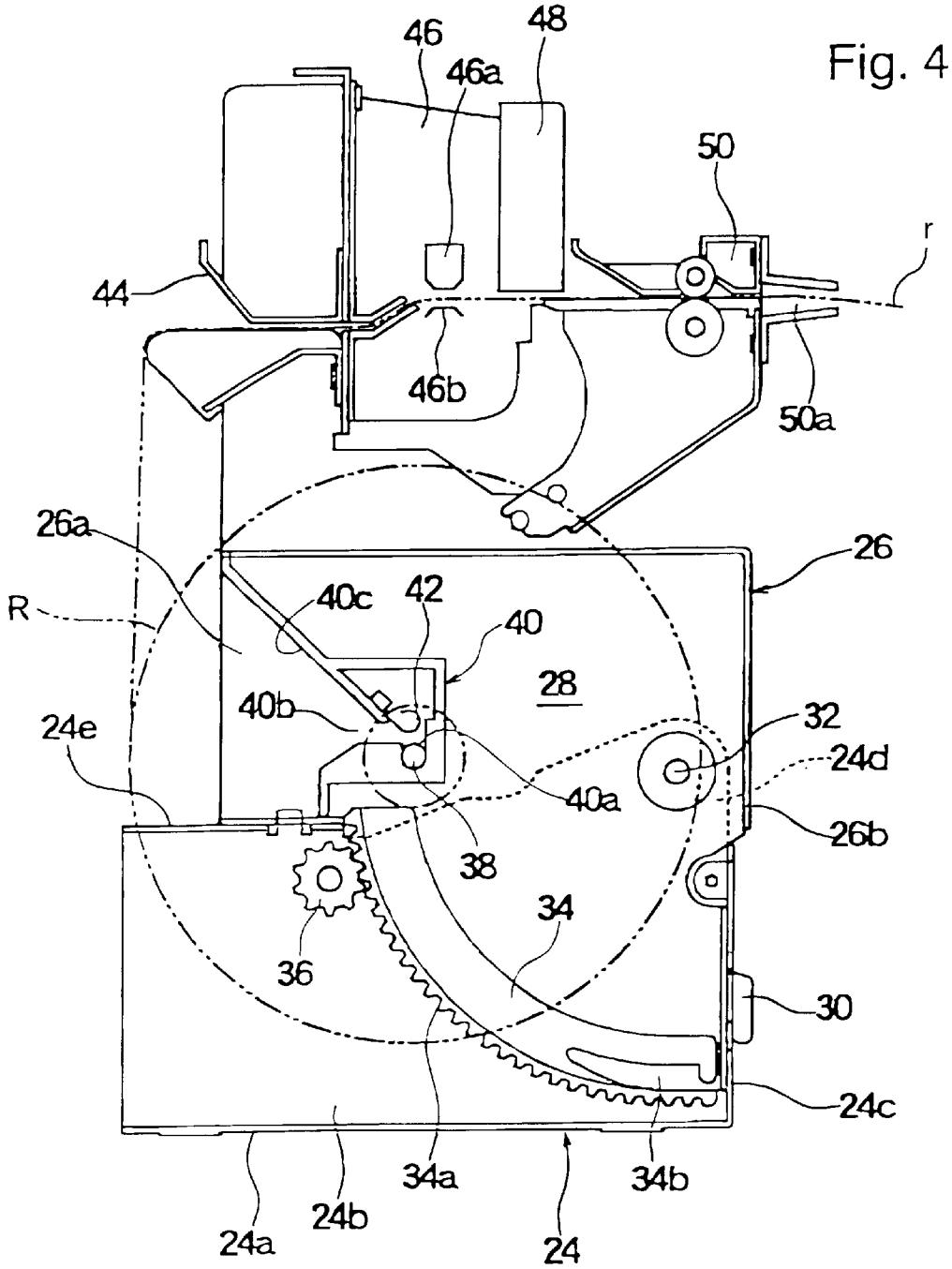
FIG. 4 is a side view of the printer unit according to the present invention.

FIGS. 2 to 4 show the appearance of the printer unit 20 according to the embodiment, and respectively are a perspective view of the front of the printer unit 20, a perspective view of the rear of the printer unit 20, and a side view of the printer unit 20. In these figures, a frame of the printer unit 20 is made up of a lower base frame 24 and an upper moving frame 26. The lower base frame 24 is fixed to the ATM terminal 10, whereas the upper moving frame 26 has mounted thereto the functional parts of the printer. A storage space 28, for storing rolled paper, is formed in a lower part of the body made up of the base frame 24 and the moving frame 26. The rolled paper R is placed into the storage space 28 by a method to be described later.

The base frame 24 is made up of a bottom face 24*a*, two sides 24*b* and 24*b*, and a front face 24*c*. The bottom face 24*a* is fixed to the inside of the body of the ATM terminal 10 by bolts or any other fastening means. The two sides 24*b* and 24*b* are formed on their fronts with support pieces 24*d* and 24*d* for supporting the moving frame 26, and are formed on their rears with abutment pieces 24*e* and 24*e* for abutting the moving frame 26. The front face 24*c* is formed with a slit for retaining a lock knob 30 to be described later.

On the other hand, the moving frame 26 is made up of two sides 26*a* and 26*a* and a front face 26*b*. The two sides 26*a* and 26*a* are attached to the support pieces 24*d* and 24*d* (of the base frame 24) for rotation, whereby the moving frame 26 is supported on the base frame 24 for rotation relative thereto. That is, the upper part of the moving frame 26 can be inclined to the front with a rotation center 32 (shown in FIG. 4) as the center for its rotation. The lock knob 30 rotatably is attached on the lower part of the front face 26*b* of the moving frame. When the lower part of the front face 26*b* is abutted against the front face 24*c* of the base frame 24, in the operating state of the printer unit, the lock knob 30 is passed through the slit in the front face 24*c* of the base frame 24, whereby the moving frame 26 can be fixed to the base frame 24 by turning the lock knob 30.

The printer unit 20 has a rack 34, and a pinion 36 for meshing with the rack 34, to regulate (by applying a load) the rotation of the moving frame 26 relative to the base frame 24. The rack 34 is attached to the side 26*a* of the moving frame 26, and the pinion 36 is attached to the both sides 24*b* of the base frame 24. The moving frame 26 has a tooth surface 34*a* that is disposed along a circular arc with the rotation center 32 as the center of the arc. The tooth surface 34*a* meshes with the pinion 36 on the move path of the tooth surface 34*a*. An area 34*b*, on one end of the rack 34 comprising the tooth surface 34*a*, is made free relative to the moving frame 26 and can be elastically deformed. Accordingly, when restoring the moving frame 26 to the former state—from the state in which the moving frame 26 is completely inclined and the tooth surface 34*a* of the rack 34 is detached from the pinion 36—the rack 34 smoothly is accepted in the pinion 36. This point will be discussed again later. The attachment position of the pinion 36, relative to the tooth surface 34*a* of the rack 34, is adjusted so as to impose a constant mesh load on it. The mesh load suppresses abrupt rotation of the moving frame 26.

The moving frame 26 comprises a bearing member 40 for supporting both ends of a shaft 38 of rolled paper R. The bearing member 40 is a block member, for example, made of a resin that is fixed to the side 26*a* of the moving frame 26. The bearing member 40 is formed with a bearing groove 40*a*, an acceptance port 40*b*, and an introduction face 40*c*. The bearing groove supports the shaft 38 of the rolled paper in the state shown in FIG. 4 for rotation. The acceptance port 40*b* makes it possible to insert the shaft 38 of the rolled paper into the bearing groove 40*a* from the rear of the moving frame. The introduction face 40*c* is continuous with the acceptance port 40*b*, and is oriented downward in the state shown in FIG. 4. A pressure bar spring 42 is attached to the bearing groove 40*a* so that the shaft 38 is not easily detached once it has been dropped into the bearing groove 40*a*. Rolled paper R is inserted into the rolled-paper storage space 28 when the moving frame 26 is inclined forward; this procedure will be discussed later.

The moving frame 26 includes, on an upper part thereof, an edge of paper insertion slot 44, a print mechanism section 46, an auto cutter 48, and a paper-discharge presenter 50. In the upper part of the moving frame 26, the edge of paper insertion slot 44, the print mechanism section 46, the auto cutter 48, and the paper-discharge presenter 50 are placed in order from back to front (from left to right in FIG. 4). An edge of paper r, drawn out from the rolled paper R, is introduced through the edge of paper insertion slot 44, onto a transport passage in the print mechanism section 46, and is printed on by a print head 46*a* that opposes a platen 46*b* placed in the transport passage. Then, the edge of paper r is cut and separated from the rolled paper R by the auto cutter 48, and is sent to the outside through a discharge port 50*a* of the paper-discharge presenter 50.

Figure 5:
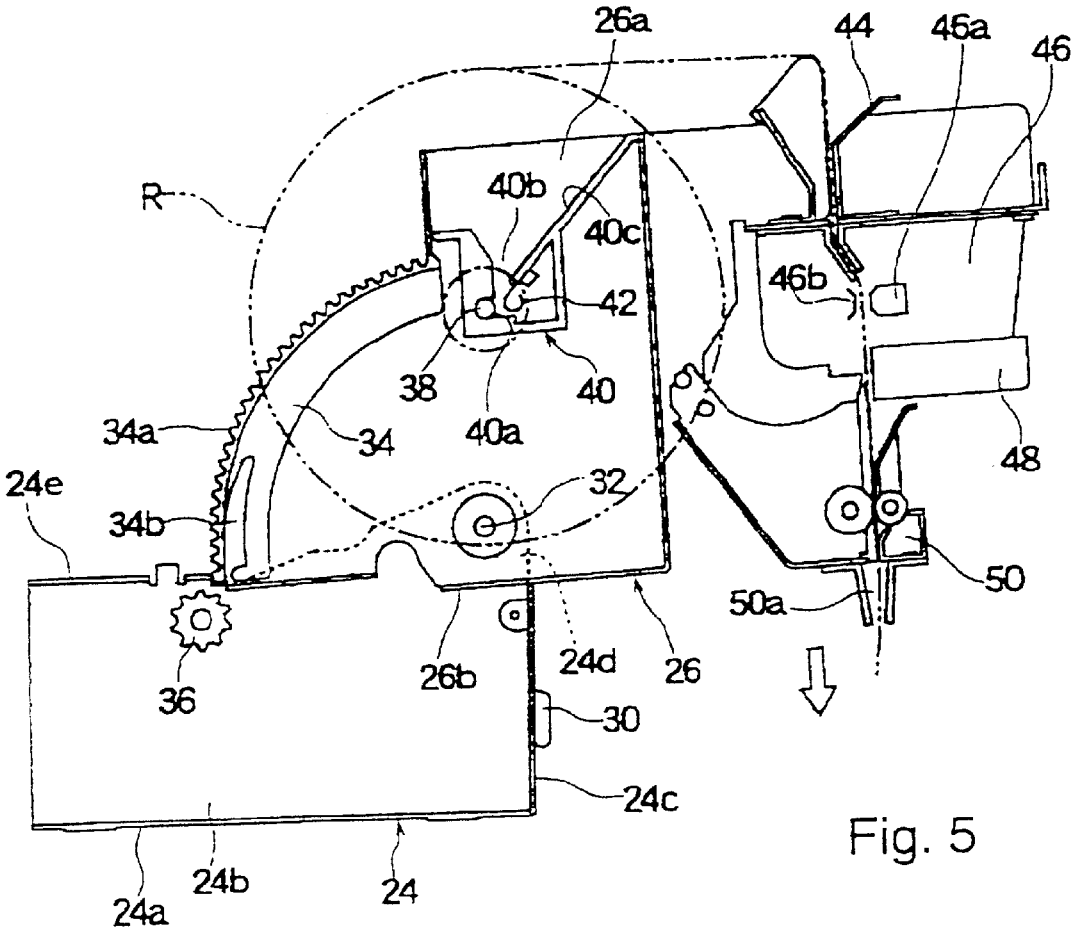
FIG. 5 is a side view of the printer unit with a moving frame inclined forward.

FIG. 5 is a side view of the printer unit with the moving frame 26 inclined forward. In this state, new rolled paper is inserted into the print unit 20, and maintenance and inspection are executed for each mechanical section. In the state shown in FIG. 4, locking of the moving frame 26 to the base frame 24 by the lock knob 30 is released, and the moving frame 26 is pulled to the front by holding an upper part of the moving frame 26, whereby the upper part is inclined forward as shown in FIG. 5. As the front face 26*b* of the moving frame 26 abuts the top face of the front face 24*c* of the base frame 24, the moving frame 26 stops, whereby the inclination angle of the moving frame 26 is determined. In the process in which the moving frame 26 is inclined to the base frame 24, the load mechanism of the rack 34 and the opinion 36 operates so as to gently rotate the moving frame 26 regardless of the load in the upper part of the moving frame 26.

In this state, the upper part of the moving frame 26, comprising the mechanical portion for printing, projects forward from the housing space of the ATM terminal 10. Thus, maintenance and inspection can be easily executed for the mechanical portion. In this state, the rear face of the moving frame 26 is oriented upward, namely, to the worker. As shown in the figures, on the rear face of the moving frame 26, the acceptance port 40*b* of the bearing member 40 is oriented upward, and the introduction face 40*c* is oriented upward at a predetermined inclination angle. When the worker places the shaft 38, of a new roll of paper, on the introduction face 40*c*, the shaft 38 proceeds along a slope of the introduction face 40*c*, goes through the acceptance port 40*b*, and enters the bearing groove 40*a*. After the rolled paper R is thusly mounted, the worker inserts the edge of paper r—of the rolled paper R—into the edge of paper insertion slot 44 that is now oriented upward. Thus, the worker easily completes setting the new rolled paper.

Figure 6:
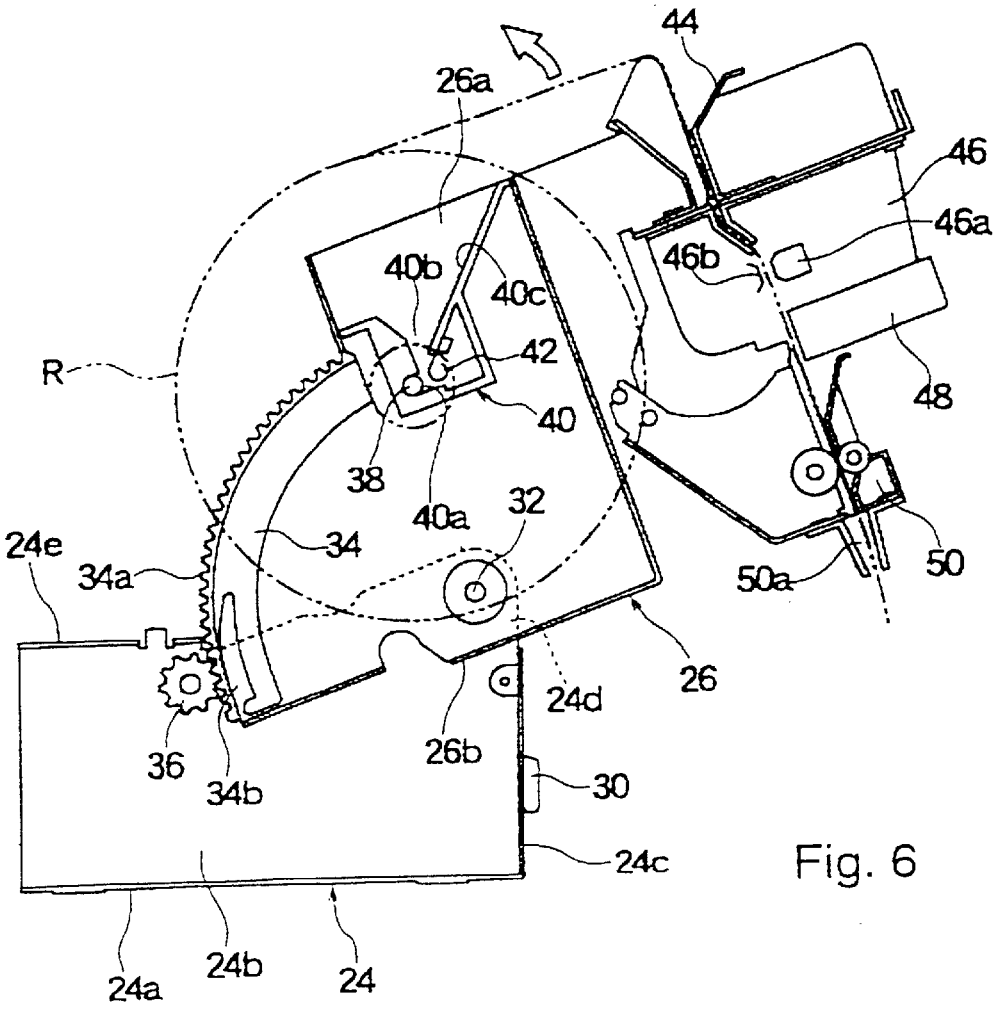
FIG. 6 is a side view showing an intermediate stage of restoring the inclined moving frame to the former state.

FIG. 6 is a side view showing an intermediate stage of restoring the inclined moving frame 26 to the former state. This figure shows a state just after the worker lifts up the moving frame 26, whereby meshing of the rack 34 and the pinion 36 is started. When the rack's tip area 34*b* meshes with the pinion 36, as the moving frame 26 is rotated, the area 34*b* is pressed by the pinion 36 and becomes deformed. Accordingly, the tooth tips of the pinion 36 and the rack 34 are not locked, whereby the pinion 36 and the tooth surface 34*a* of the rack 34 smoothly mesh with each other. After this smooth meshing, load is imposed on rotation of the moving frame 26, whereby it is guaranteed that the moving frame 26 rotates smoothly regardless of the weight of the upper part of the moving frame 26.

Figure 7:
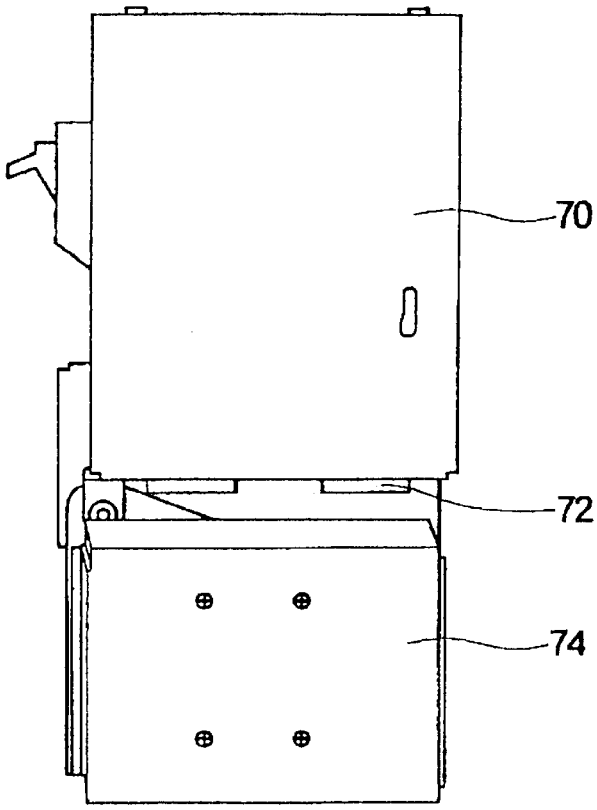
FIG. 7 is a right-side view of the printer unit.

FIG. 7 shows the right side of the printer unit 20. In this figure, a control unit 70 (shaped like a box) is placed on the right side of the moving frame 26. The control unit 70 contains a control board for executing various types of control including print control in the print mechanism section 46, paper transport control, and paper cut control in the auto cutter 48. The control unit 70 comprises a communication interface 72 with an external system on the lower side. Various connection cables from the transaction device are connected to the interface 72, whereby it is made possible to receive control commands from the transaction device. An RS-232 interface, a parallel interface, etc., is used as the communication interface 72 with the external system.

An optionally provided USB connection unit 74, shaped like a box, is placed on the right side of the base frame 24. By adopting USB as the communication interface's external system, it is made possible for the control unit 70 to communicate with the external system through the USB connection unit 74.

Figure 8:
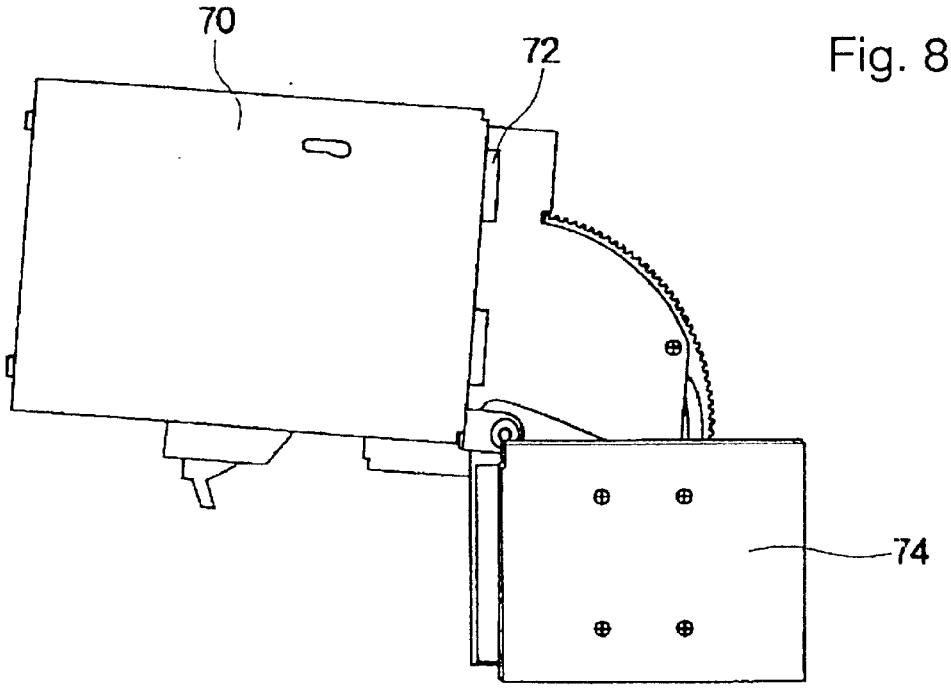
FIG. 8 is a right-side view of the printer unit with the moving frame inclined for maintaining and inspecting the printer unit.

FIG. 8 is a right side view of the printer unit with the moving frame inclined for maintaining and inspecting the printer unit. As shown in this figure, in this state, the interface 72 of the control unit 70 becomes disposed at an almost vertical state on the rear side of the printer unit 20. Thus, the worker can extend his or her arm for accessing the interface 72 from the front side of the printer unit 20, and can maintain and inspect the interface. The inclination angle of the moving frame 26 can be set to 90 degrees or more, whereby the interface 72 is oriented slightly upward on the rear side of the printer unit 20, so that the worker can access the interface 72 more easily.

Figure 9:
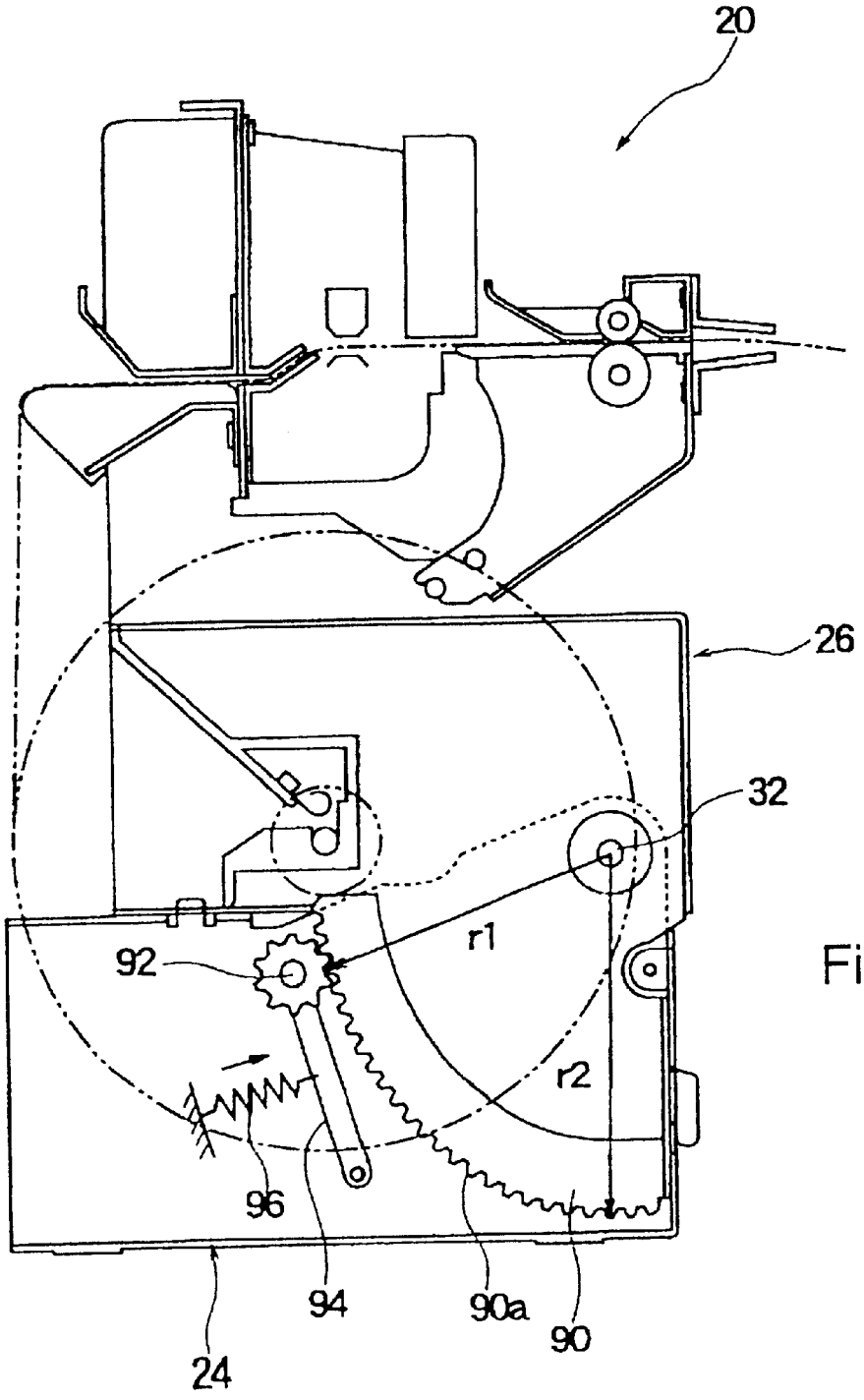
FIG. 9 is a side view of the printer unit, and shows another embodiment of a load generating mechanism of the moving frame.
Figure 10:
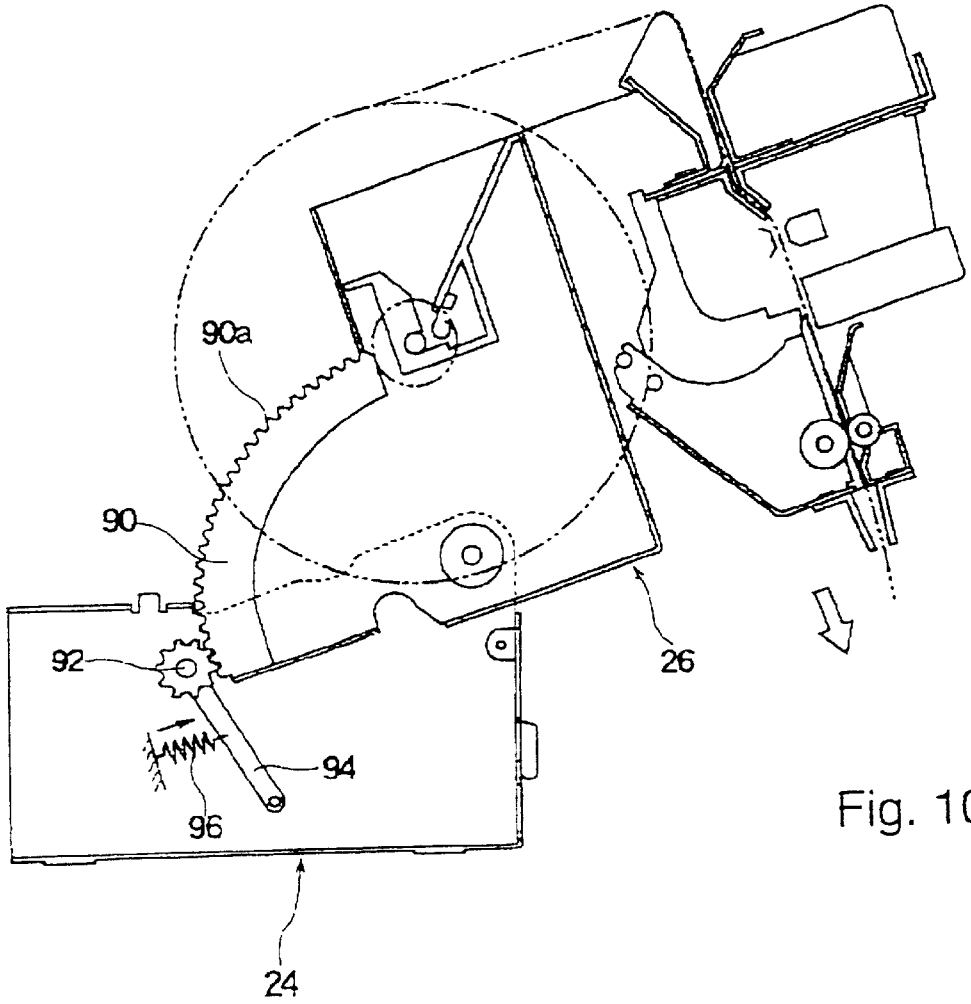
FIG. 10 is a drawing corresponding to FIG. 9 with the moving frame inclined.

FIGS. 9 and 10 show another embodiment of the load generating mechanism of the printer unit's moving frame 26. The load mechanism in this embodiment is configured so that as the inclination angle of the moving frame 26 (relative to the base frame 24) increases, load on rotation of the moving frame 26 increases. The load mechanism comprises a rack 90, and a pinion 92 for meshing with the rack 90, basically like the load mechanism in the above-described embodiment. In this embodiment, however, the rack 90 has a tooth surface 90*a* placed along a line that gradually shifts to the side of the pinion 92 as the inclination angle of the moving frame 26 increases, wherein the line shifts relative to a circular arc having the rotation center 32 of the moving frame 26 as its center. That is, as shown in FIG. 9, the tooth surface 90*a* of the rack 90 is placed at the position of a minimum radius r1 from the center 32 at an upper end part of the tooth surface 90*a*, is placed at the position of a maximum radius r2 at a lower end part of the tooth surface 90*a*, and is formed so that the radius of the tooth surface 90*a* gradually increases from r1 to r2 between the above-noted positions.

On the other hand, the pinion 92 is attached to the tip of an arm 94 that is rotatably supported on the base frame 24. Also, the arm 94 is urged by a spring 96 so as to mesh the pinion 92 with the tooth surface 90*a* of the rack 90. In this configuration, when the moving frame 26 is rotated relative to the base frame 24, the rack 90 moves on the pinion 92 while it meshes with the pinion 92. At this time, the radius of the tooth surface 90*a* gradually grows from r1 to r2 and, thus, the mesh load between the rack 90 and the pinion 92 gradually increases. The inclination angle of the moving frame 26 increases and, if rotation of the moving frame 26 is about to be accelerated because of the weight of the upper part of the moving frame 92, the rotation acceleration is suppressed as the mesh load grows; the moving frame 26 thusly is rotated stably.

While the embodiments of the invention have been described with reference to the accompanying drawings, it is to be understood that the invention is not limited to these embodiments, but instead includes a scope in which those skilled in the art can make modifications based on the scope of the claims, the detailed description of the invention, and well-known arts. In these embodiments, the printer unit according to the invention is installed in an ATM terminal, but can also be installed in any other transaction device, such as a ticket dispenser, a reservation machine of concerts, etc., or a selling terminal of games, music software, etc.

As described above, according to the invention, the moving frame is inclined forward relative to the base frame, whereby the workability for replacing rolled paper and maintaining and inspecting the machine greatly is improved.

The necessity for drawing out the whole printer unit from the body of the transaction device to conduct the maintenance and inspection work is eliminated, so that the workspace can be minimized.

The rolled-paper journaling shaft exists in the moving frame. Thus, when the moving frame is inclined forward and rolled paper is set and then the moving frame is restored to the base frame side, slack in the rolled-paper does not occur. Accordingly, the rolled paper easily can be set.

What is claimed is:

1. A printer unit, for installation in a body of an installation-type transaction device to supply an edge of paper of printed rolled-paper from a front of the installation-type transaction device, said printer unit comprising:

a base frame for fixation to the inside of the body of the installation-type transaction device;

a moving frame placed on said base frame and supported on said base frame for rotation relative thereto about a rotation center, so that an upper part of said moving frame can be inclined to the front of the installation-type transaction device, said moving frame forming, together with said base frame, a storage space for rolled paper;

a bearing member, attached to a side of said moving frame, for supporting a shaft of the rolled paper stored in the rolled-paper storage space, said bearing member having an acceptance port opened in a rear face of said moving frame, wherein said acceptance port receives the shaft of the rolled paper;

a print mechanism section placed above the rolled-paper storage space in said moving frame;

an edge of paper insertion slot attached to a side of said moving frame for guiding the edge of paper, of the rolled paper stored in the storage space, to said print mechanism section, said edge of paper insertion slot being oriented to the rear face of said moving frame; and an edge of paper discharge port, attached to a side of said moving frame, for discharging the edge of paper of the rolled paper to the front of the installation-type transaction device.

2. The printer unit for a transaction device as claimed in claim 1, further comprising:

a load generating mechanism including a rack, and a pinion for meshing with the rack, wherein the rack is attached to one of said base frame and said moving frame, and the pinion is attached to the other of said base frame and said moving frame so that the load generating mechanism generates a load that resists rotation of said moving frame relative to said base frame.

3. The printer unit for a transaction device as claimed in claim 2, wherein the rack of the load generating mechanism has a tooth surface that is placed along a circular arc having the rotation center of said moving frame as its center.

4. The printer unit for a transaction device as claimed in claim 2, wherein the rack of the load generating mechanism has a tooth surface that is placed along a line that gradually shifts to the pinion side as the inclination angle of said moving frame increases, wherein the shift is relative to a circular arc having the rotation center of said moving frame as its center so that as the inclination angle of said moving frame increases, the load resisting rotation of said moving frame increases.

5. The printer unit for a transaction device as claimed in claim 1, wherein said bearing member further comprises an introduction face that is inclined horizontally when said moving frame is inclined, for introducing the shaft of the rolled paper into the acceptance port.

6. The printer unit for a transaction device as claimed in claim 1, further comprising:

a printer control unit attached to the side of said moving frame and having a connection interface section for communicating with the installation-type transaction device.

7. A printer unit, for a transaction device, comprising:

a base frame;

a moving frame rotatable, about a rotation center, between a first position and a second position with respect to said base frame in such a manner that said moving frame is rotatable to the first position so as to store rolled paper in a rolled-paper storage space and said moving frame is rotatable to the second position so as to allow replacement of the rolled paper, said moving frame including:

a rolled-paper shaft for supporting the rolled paper;

a print head for printing on the rolled paper; and a paper-discharge presenter for discharging the paper printed by the print head, wherein said moving frame is rotatable relative to said base frame by a rack and pinion, and the rack is disposed along an arc having the rotation center as its center.

8. A printer unit, for a transaction device, comprising:

a base frame;

a moving frame rotatable, about a rotation center, between a first position and a second position with respect to said base frame in such a manner that said moving frame is rotatable to the first position so as to store rolled paper in a rolled-paper storage space and said moving frame is rotatable to the second position so as to allow replacement of the rolled paper, said moving frame including:

a rolled-paper shaft for supporting the rolled paper;

a print head for printing on the rolled paper; and a paper-discharge presenter for discharging the paper printed by the print head; and a rack and pinion disposed between said base frame and said moving frame, wherein said rack and pinion are loaded to regulate rotation of said moving frame relative to said base frame, and wherein the rack is disposed along an arc having the rotation center as its center.

9. A printer unit for a transaction device as claimed in claim 8, wherein the pinion is attached at one end of an arm that is rotatably supported on said base frame at an opposite end thereof, said arm being urged by a spring to engage the pinion with the rack.

10. A printer unit for a transaction device as claimed in claim 9, wherein a radius of the rack arc increases from the first position to the second position of said moving frame.

* * * * *